US005413062A

United States Patent [19]

Koss

[11] Patent Number: 5,413,062

[45] Date of Patent: May 9, 1995

[54] REMOTELY CONTROLLED STEERING APPARATUS FOR OUTBOARD MOTOR

[76] Inventor: Edward S. Koss, 8187 Whitefield, Dearborn Heights, Mich. 48127

[21] Appl. No.: 200,919

[22] Filed: Feb. 22, 1994

Related U.S. Application Data

[63] Continuation of Ser. No. 878,686, May 5, 1992, abandoned.

[51] Int. Cl.[6] ..... B63H 25/00

[52] U.S. Cl. ..... 114/144 A; 440/60; 440/900

[58] Field of Search ..... 114/114 A, 144 R, 144 C, 114/159, 153, 154; 440/7, 53, 58, 60–63, 900; 74/480 B

[56] References Cited

U.S. PATENT DOCUMENTS

| | | | |
|---|---|---|---|
| 2,583,059 | 1/1952 | Neville | 318/467 |
| 2,742,735 | 4/1956 | Sommerhoff | 114/144 R |
| 3,080,953 | 3/1963 | Edgemond, Jr. | 114/144 R |
| 3,503,360 | 3/1970 | Hoff | 440/63 |
| 3,598,947 | 8/1971 | Osborn | 114/144 R |
| 3,832,967 | 9/1974 | Warner et al. | 114/144 R |
| 4,909,765 | 3/1990 | Riske et al. | 114/144 R |
| 4,915,050 | 4/1990 | Wicker et al. | 114/144 RE |

FOREIGN PATENT DOCUMENTS

| | | | |
|---|---|---|---|
| 20532 | 7/1909 | United Kingdom | 114/159 |

*Primary Examiner*—Ed Swinehart
*Attorney, Agent, or Firm*—Bliss McGlynn

[57] ABSTRACT

A steering apparatus for an outboard motor includes an electrically-energized motor having a pinion meshed with a pivotally mounted gear sector. A linkage connects the gear sector to the outboard motor such that by energizing the electrical motor to rotate the shaft in a selected direction, the direction of the propeller thrust can be controlled.

20 Claims, 2 Drawing Sheets

FIG 5
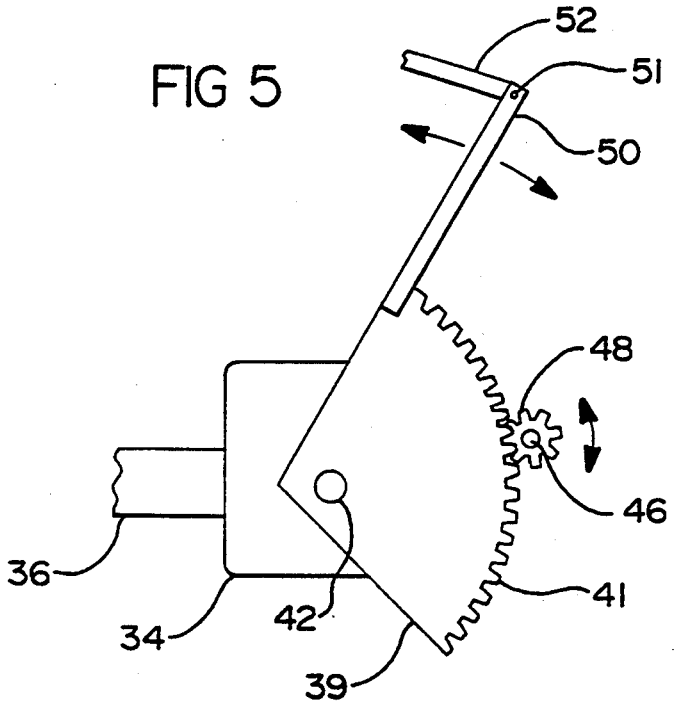
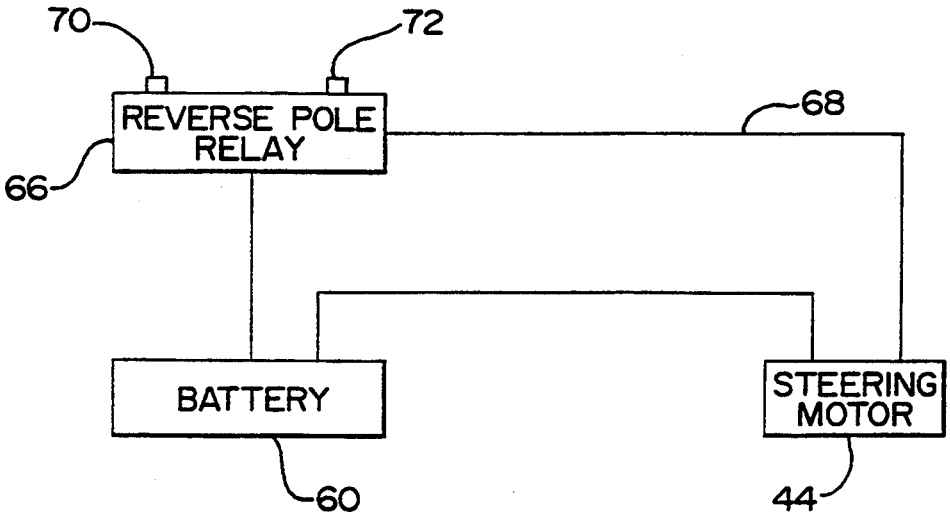
FIG 6

REMOTELY CONTROLLED STEERING APPARATUS FOR OUTBOARD MOTOR

The present application is a continuation of application Ser. No. 07/878,686, filed on May 5, 1992, now abandoned in favor of this continuation.

FIELD OF THE INVENTION

This invention is related to apparatus which may be mounted on an outboard motor so as to be carried with the motor when it is not being used on the boat, and more particularly to a steering apparatus powered by an electric motor with a switch remotely located in the boat for controlling the electric motor.

BACKGROUND OF THE INVENTION

Outboard motors are commonly manually steered by the user. A typical outboard motor comprises a gasoline engine mounted on a base that is clamped to the stern transom of the boat. The engine is pivoted on the base thereby changing the direction of the propeller thrust.

It is desirable to steer the outboard motor from a remote position in the boat. One such apparatus is illustrated in U.S. Pat. No. 4,915,050 which issued Apr. 10, 1990 to Ronald E. Wicker and Willis J. Patterson. This arrangement employs a capstan driven by an electric motor. The capstan drives a flexible cable which steers the engine depending upon the direction of rotation of the capstan.

U.S. Pat. No. 2,583,059 which was issued Jan. 22, 1952 to William H. Neville discloses an outboard motor with an electric motor for turning a rudder to steer the boat.

SUMMARY OF THE PRESENT INVENTION

The broad purpose of the present invention is to provide an improved, compact steering apparatus for remotely steering a portable outboard motor. The apparatus may be attached to the outboard motor such that it can be readily carried with the motor when it has been removed from the boat.

The preferred embodiment of the invention comprises a gear sector pivotally mounted on a frame attached to the conventional U-shaped clamping means of lightweight outboard motors. The frame also supports a direct current motor having a pinion meshed with the gear sector. A linkage train connects the sector to the outboard motor steering frame. When the electric motor is rotated in one direction, the pinion pivots the gear sector and thereby swings the engine toward one direction. When the motor shaft is rotated in the opposite direction, the pinion pivots the gear sector and thereby swings the outboard motor in the opposite direction.

A remotely located switch mounted in the boat is electrically connected between a battery and the engine for controlling the rotation of the pinion between either clockwise, or counterclockwise rotation or a neutral position. The switch has a neutral position when the outboard motor is driving the boat on a given course.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which:

FIG. 5 is a view illustrating the manner in which the steering motor pinion pivots the gear sector in order to change the direction of the propeller thrust.

FIG. 6 is a schematic electrical diagram of the steering motor circuitry.

DESCRIPTION OF THE PREFERRED EMBODIMENT

Figure 1:
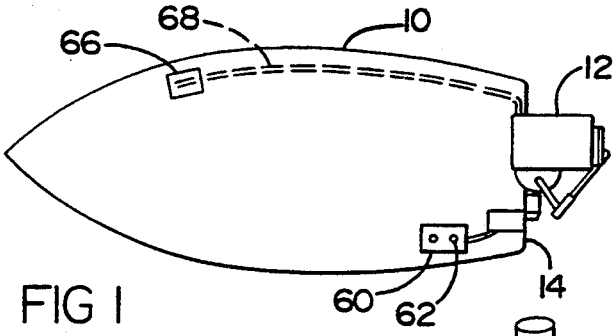
FIG. 1 is a plan view of a boat having an outboard motor with a steering apparatus illustrating in the preferred embodiment of the invention.

FIG. 1 illustrates a conventional boat 10 having a conventional outboard motor 12 mounted on stern transom 14 of the boat. For illustrative purposes, the outboard motor may be a 7.5 horsepower Sea King motor. A conventional motor of this type includes a mounting base 16 which is attached by clamping means 18 to the boat transom.

Figure 4:
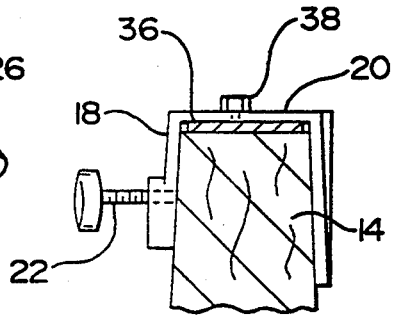
FIG. 4 is a view of the outboard motor clamp means mounted on the boat transom.

As best illustrated in FIG. 4, clamping means 18 includes a U-shaped clamping member 20 which straddles the top edge of the transom. A clamping screw 22 is manipulated to firmly connect the outboard motor to the transom.

The outboard motor also includes an internal combustion engine 24 connected in the conventional manner to a vertical shaft 26. Shaft 26 is drivingly connected to propeller means 28 which is disposed beneath the surface of the water when the boat is to be driven. The engine is pivotally mounted on the base about an upright axis illustrated at "A". When the engine is pivoted on base 16, shaft 26 and propeller means 28 are also pivoted to change the direction of thrust of the propeller means with respect to the boat.

A steering frame 30 is carried with the engine housing. A pivotal handle 32 is mounted on frame 30. The handle may be lowered to a generally horizontal position when it is to be used for manually steering the engine, or may be raised to the position illustrated in FIG. 2, when the outboard motor is either being transported or is being steered by the preferred steering apparatus.

Figure 2:
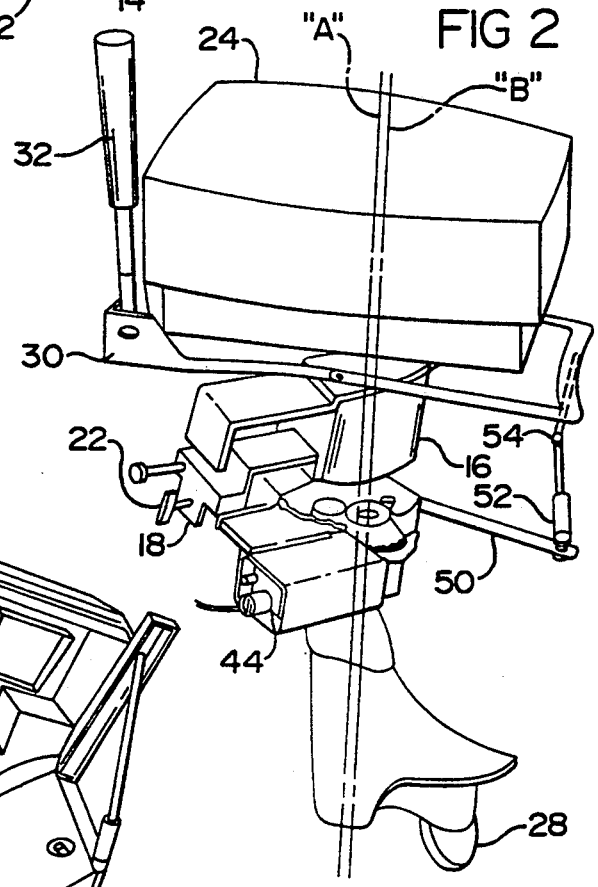
FIG. 2 illustrates the outboard motor removed from the boat but attached to the steering motor.
Figure 3:
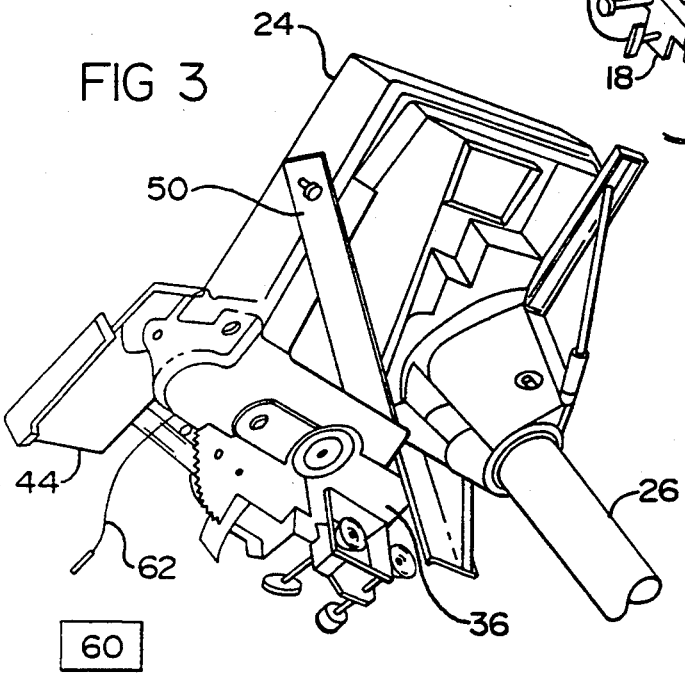
FIG. 3 shows the outboard motor separated from the steering motor linkage.

Referring to FIGS. 2, 3 and 5, a preferred steering apparatus comprises a stamped metal base 34. An arm 36 extends from the base and is preferably attached by fastener means 38 to the midsection of the clamp, as illustrated in FIG. 4. The arrangement is such that the steering motor base 34 may be carried with the outboard motor when it is removed from the boat. In addition, steering motor base 34 is fixed with respect to base 16 of the outboard motor. Steering base 34 is in a generally horizontal position when mounted on the boat transom.

A steel gear sector 39 is mounted by pivot means 42 on base 34. The gear sector has an array of teeth 41 formed about the pivot axis "B" of pivot means 42. The gear sector is preferably supported such that axis "B" is supported in an upright position generally parallel to the pivot axis "A" of engine 24.

A direct current electric motor 44 is also mounted on base 34. Motor 44 has a selectively reversible shaft 46. A pinion 48 is carried on shaft 46 so as to be rotatable with the shaft. The pinion teeth are meshed with teeth 41 of the gear sector in such a manner that, as viewed in FIG. 5, as the pinion is rotated in the clockwise direction, it causes the gear sector to be pivoted in the counterclockwise direction. Similarly, as the pinion is rotated in the counterclockwise direction, the gear sector is pivoted in the opposite direction.

An arm 50 is carried by the gear sector. A pivotal connector 51 connects link 52 to the outer end of arm 50. The pivotal connection 51 may be a conventional spring-loaded ball connection so that the arm can be readily disconnected from link 52. The link is connected by a pivotal connector 54 to the rear of steering frame 30 of the outboard motor. The connection of link 52 to the engine is spaced with respect to pivotal axis "A" of the engine to provide a sufficient torque for turning the engine as the gear sector is being turned.

A battery 60 is mounted in the boat. Cable means 62 electrically connect the battery to steering motor 44. A remote, button-operated switch 66 may be mounted or remotely held in any part of the boat and electrically connected by cable means 68 to the motor.

Switch 66 may be located anywhere in the boat for energizing and controlling the steering motor An electric circuit is illustrated in FIG. 6. Switch 66 may comprise a reverse pole relay having a pair of buttons 70 and 72. When button 72 is depressed, power is delivered from the battery to the steering motor to rotate the pinion in a clockwise direction. When button 72 is depressed, power is delivered from the battery to the steering motor to rotate the pinion in the counterclockwise direction. When neither button is being depressed, the motor is not energized and consequently the propeller means remains in a fixed steering position until one of the buttons is depressed to change the steering direction of the propeller means.

The combined weight of the steering motor, base 34 and the accompanying linkage is relatively light. The position of the steering motor components is close to that of the outboard motor so that the outboard motor can be readily carried with the steering motor by the user when he removes it from the boat.

Having described my invention, I claim:

1. An apparatus for steering a boat having an outboard motor, the outboard motor having a base fixedly mounted on the boat, and an engine carried with a steering frame pivotally mounted on the base, and propeller means connected to the engine so as to be pivotal therewith about an upright first axis to change the direction of thrust of the propeller means, comprising:

a frame;

an electrically-powered steering motor mounted on the frame, the steering motor having a selectively reversible shaft;

a gear sector having a series of gear teeth formed about a second axis;

means pivotally mounting the gear sector on the frame;

means for support of the frame on the boat;

linkage means for connection of the gear sector to a generally rearward portion of the steering frame of the engine such that the engine and the propeller means are pivoted about the first axis as the gear sector is pivoted about the second axis;

a pinion carried on the steering motor shaft and meshed with the gear sector to pivot the gear sector in the direction depending upon the direction of rotation of the steering motor shaft; and switch means for energizing the electric motor to rotate the pinion in either a first direction or in a second direction in order to change the direction of thrust of the propeller means with respect to the boat.

2. Apparatus as defined in claim 1, in which the switch means includes a switch electrically and remotely connected to the steering motor for energizing the motor from any position in the boat remote from the outboard motor.

3. Apparatus as defined in claim 1, including means for connecting the steering motor frame to the base whereby the steering motor and the outboard motor may be removed as a unit from the boat.

4. Apparatus as defined in claim 1, in which the boat has a stern transom, and the outboard motor base includes a generally U-shaped clamping means for embracing the transom, and the steering motor frame is attached to the U-shaped clamping means.

5. A selectively connectible apparatus for steering a boat having an outboard motor, the outboard motor having a base fixedly mounted on the boat, and an engine pivotally mounted on the base, and propeller means connected to the engine so to be pivotal therewith about an upright first axis to change the direction of thrust of the propeller means, comprising:

a frame for removable mounting of the apparatus to the base of the outboard motor;

steering means mounted on the frame, the steering means comprising a selectively reversible shaft;

a gear sector having a series of gear teeth formed about a second axis;

means pivotally mounting the gear sector on the frame;

means for support of the frame on the boat;

a selectively connectible linkage means for connection of the gear sector to the engine such that the engine and the propeller means are pivoted about the first axis as the gear sector is pivoted about the second axis;

a pinion carried on the steering means shaft and meshed with the gear sector to pivot the gear sector in the direction depending upon the direction of rotation of the steering means shaft.

6. The apparatus of claim 5 wherein said steering means further comprises an electrically-powered steering motor.

7. The apparatus of claim 6 further comprising switch means for energizing the electric motor to rotate the pinion in either a first direction or in a second direction in order to change the direction of thrust of the propeller means with respect to the boat.

8. Apparatus as defined in claim 7, in which the switch means includes a switch electrically and remotely connected to the steering motor for energizing the motor from a position in the boat remote from the outboard motor.

9. Apparatus as defined in claim 5, in which the boat has a stern transom, and the outboard motor base includes a generally U-shaped clamping means for embracing the transom, and the steering means frame is attached to the U-shaped clamping means.

10. Apparatus as defined in claim 6, in which the boat has a stern transom, and the outboard motor base includes a generally U-shaped clamping means for embracing the transom, and the steering motor frame is attached to the U-shaped clamping means.

11. Apparatus as defined in claim 7, in which the boat has a stern transom, and the outboard motor base includes a generally U-shaped clamping means for embracing the transom, and the steering motor frame is attached to the U-shaped clamping means.

12. Apparatus as defined in claim 5, in which the engine has a steering frame, and said linkage means connects the gear sector to the steering frame.

13. A selectively connectible apparatus for steering a boat having an outboard motor, the outboard motor having a base fixedly mounted on the boat, and an engine pivotally mounted on the base, and propeller means connected to the engine so as to be pivotal therewith about an upright first axis to change the direction of thrust of the propeller means, comprising:

frame removably mounted to the base of the outboard motor;

steering means mounted on the frame, the steering means comprising a selectively reversible shaft;

a gear pivotable about a second axis;

means pivotally mounting the gear on the frame;

means for support of the frame on the boat;

a selectively connectible linkage means for connection of the gear to the engine such that the engine and the propeller means are pivoted about the first axis as the gear is pivoted about the second axis;

a pinion carried on the steering means shaft and meshed with the gear to pivot the gear in the direction depending upon the direction of rotation of the steering means shaft.

14. The apparatus of claim 13 wherein said steering means further comprises an electrically-powered steering motor.

15. The apparatus of claim 14 further comprising switch means for energizing the electric motor to rotate the pinion in either a first direction or in a second direction in order to change the direction of thrust of the propeller means with respect to the boat.

16. Apparatus as defined in claim 15, in which the switch means includes a switch electrically and remotely connected to the steering motor for energizing the motor from a position in the boat remote from the outboard motor.

17. Apparatus as defined in claim 13, in which the boat has a stern transom, and the outboard motor base includes a generally U-shaped clamping means for embracing the transom, and the steering means frame is attached to the U-shaped clamping means.

18. Apparatus as defined in claim 14, in which the boat has a stern transom, and the outboard motor base includes a generally U-shaped clamping means for embracing the transom, and the steering motor frame is attached to the U-shaped clamping means.

19. Apparatus as defined in claim 15, in which the boat has a stern transom, and the outboard motor base includes a generally U-shaped clamping means for embracing the transom, and the steering motor frame is attached to the U-shaped clamping means.

20. Apparatus as defined in claim 15, in which the engine has a steering frame, and said linkage means connects the gear to the steering frame.

* * * * *